US010398206B2

(12) United States Patent
Bellas et al.

(10) Patent No.: US 10,398,206 B2
(45) **Date of Patent: *Sep. 3, 2019**

(54) COSMETICS CONTAINER

(71) Applicant: Make-Cup, L.L.C., Rochester, MI (US)

(72) Inventors: Christina Bellas, Commerce, MI (US); Karl Sommer, Rochester Hills, MI (US); Richard Alan Knill, Shelby Township, MI (US)

(73) Assignee: Make-Cup, L.L.C., Rochester, MI (US)

( * ) Notice: Subject to any disclaimer, the term of this patent is extended or adjusted under 35 U.S.C. 154(b) by 483 days.

This patent is subject to a terminal disclaimer.

(21) Appl. No.: 15/075,394

(22) Filed: Mar. 21, 2016

(65) Prior Publication Data

US 2016/0198826 A1 Jul. 14, 2016

Related U.S. Application Data

(63) Continuation of application No. 13/948,563, filed on Jul. 23, 2013, now Pat. No. 9,289,042.

(60) Provisional application No. 61/674,541, filed on Jul. 23, 2012.

(51) Int. Cl.

| | |
|---|---|
| ***A45C 11/00*** | (2006.01) |
| ***A45D 40/00*** | (2006.01) |
| ***B65D 25/04*** | (2006.01) |
| ***B65D 43/02*** | (2006.01) |
| ***B65D 51/28*** | (2006.01) |

(52) U.S. Cl.

CPC ..... *A45C 11/008* (2013.01); *B65D 25/04* (2013.01); *B65D 43/02* (2013.01); *B65D 51/28* (2013.01); *A45D 40/00* (2013.01)

(58) Field of Classification Search

CPC ..... A45C 11/008; A45D 40/00

USPC ..... 220/521–522, 503, 505–506; 132/294–295; 206/823, 38, 235

See application file for complete search history.

(56) References Cited

U.S. PATENT DOCUMENTS

| | | | |
|---|---|---|---|
| 1,385,484 | A | 7/1921 | Case |
| 1,421,311 | A | 6/1922 | Rope |
| 1,683,851 | A | 9/1928 | Wells |
| 2,077,219 | A | 4/1937 | Conner |
| 2,204,784 | A | 6/1940 | Albert |
| 2,287,530 | A | 6/1942 | Morando |
| 2,663,450 | A | 12/1953 | Bourcart |
| 3,392,868 | A | 7/1968 | Pfrommer |
| 3,441,033 | A | 4/1969 | Flax |

(Continued)

OTHER PUBLICATIONS

U.S. Appl. No. 60/949,079, Bellas.

*Primary Examiner* — Anthony D Stashick
*Assistant Examiner* — Kaushikkumar A Desai

(57) ABSTRACT

A container for storing cosmetics or cosmetics accessories includes a main body having an inner storage compartment. An upper cap portion is removably attached to an upper end of the main body and includes a plurality of shelves. Each of the shelves is rotatable to the left or right of a central axis of the container, independently of remaining ones of the shelves, between a closed position and a respective open position. When each of the shelves is in the closed position, shelves are substantially concentric with each other and with a first opening in the upper end of the main body. When the shelves are in the respective open positions, the shelves are not concentric with each other or with the first opening. When the shelves are in the respective open positions, the first opening is revealed to provide access to the inner storage compartment.

20 Claims, 6 Drawing Sheets

(56) References Cited

U.S. PATENT DOCUMENTS

| | | | |
|---|---|---|---|
| 3,485,416 | A | 12/1969 | Fohrman |
| 3,804,053 | A | 4/1974 | Gray |
| D268,240 | S | 3/1983 | Crespi |
| 4,444,324 | A | 4/1984 | Grenell |
| 4,560,078 | A | 12/1985 | Dubuisson |
| 4,706,559 | A | 11/1987 | De Zarate |
| 4,777,969 | A | 10/1988 | Holloway |
| 4,807,773 | A | 2/1989 | Tsai |
| 4,815,483 | A | 3/1989 | DuGrenier et al. |
| 5,025,817 | A | 6/1991 | Wen |
| 5,423,434 | A | 6/1995 | Chen |
| 5,499,738 | A | 3/1996 | Burleigh |
| 5,597,086 | A | 1/1997 | King-Shui |
| 5,881,742 | A | 3/1999 | Hunsberger |
| 6,123,198 | A | 9/2000 | Pflueger et al. |
| 6,145,515 | A | 11/2000 | Wu |
| 6,196,412 | B1 | 3/2001 | Cattell |
| 6,223,921 | B1 | 5/2001 | Huang |
| 6,382,452 | B1 | 5/2002 | Getachew et al. |
| 6,619,297 | B2 | 9/2003 | Sheng |
| 6,772,899 | B2 | 8/2004 | Delmon |
| 6,923,335 | B2 | 8/2005 | Fujita et al. |
| 7,006,405 | B1 | 2/2006 | Huang |
| 7,226,227 | B2 | 6/2007 | Gueret |
| 7,287,656 | B2 | 10/2007 | Guilford, III et al. |
| 7,614,405 | B2 | 11/2009 | Allen et al. |
| 8,109,280 | B2 | 2/2012 | Winckels et al. |
| 8,387,812 | B2 | 3/2013 | Delage et al. |
| 8,919,355 | B2 | 12/2014 | Blanch |
| 2008/0023023 | A1 | 1/2008 | Boye et al. |
| 2008/0225518 | A1 | 9/2008 | Devaney et al. |
| 2009/0016799 | A1 | 1/2009 | Bellas |
| 2009/0320874 | A1 | 12/2009 | Boye et al. |
| 2012/0075844 | A1 | 3/2012 | Imagi et al. |

COSMETICS CONTAINER

CROSS-REFERENCE TO RELATED APPLICATIONS

The present disclosure is a continuation of U.S. patent application Ser. No. 13/948,563 (now U.S. Pat. No. 9,289,042), filed on Jul. 23, 2013, which claims the benefit of U.S. Provisional Application No. 61/674,541, filed on Jul. 23, 2012. The entire disclosures of the applications referenced above are incorporated herein by reference.

FIELD

The present disclosure relates to a cosmetics container, and more specifically to a cosmetics container that stores and facilitates access to a variety of types of cosmetics.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A cosmetics user typically uses and carries a variety of cosmetics, and/or a variety of instruments for applying cosmetics. For example only, the cosmetics may include, but are not limited to, eye shadow, blush, bronzer, foundation, concealer, eyeliner, lip liner, lip gloss, lipstick, mascara, a brow pencil or powder, makeup brushes, tweezers, and/or toothpicks. Accordingly, the user may need to store and/or carry a large number of items.

SUMMARY

A container for storing at least one of cosmetics and cosmetics accessories includes a main body having an inner storage compartment accessible via a first opening in an upper end of the main body. An upper cap portion is removably attached to the upper end of the main body and includes a plurality of shelves. Each of the plurality of shelves is rotatable to the left or right of a central axis of the container, independently of remaining ones of the plurality of shelves, between a closed position and a respective open position. When each of the plurality of shelves is in the closed position, the plurality of shelves are substantially concentric with each other and with the first opening of the main body. When the plurality of shelves are in the respective open positions, the plurality of shelves are not concentric with each other or with the first opening of the main body. When each of the plurality of shelves are in the respective open positions, the first opening of the main body is revealed to provide access to the inner storage compartment.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

A cosmetics container according to the principles of the present disclosure provides a user storage and facilitated access for a large variety of cosmetics related items. The cosmetics container has a compact structure arranged to accommodate different shapes and sizes of cosmetics items. For example, a main body of the container may include multiple compartments for receiving cosmetics inserted in a top opening of the container. The multiple compartments may have different shapes, opening sizes, and depths to accommodate different types of cosmetic items. The container includes a removable upper cap portion arranged to cover the top opening of the container. The upper cap portion may include one or more rotatable storage shelves arranged to include different cosmetics items. A lid of the upper cap portion may open (e.g., via a hinged attachment) to expose a mirror on an inner surface of the lid and an uppermost shelf of the upper cap portion.

Figure 1:
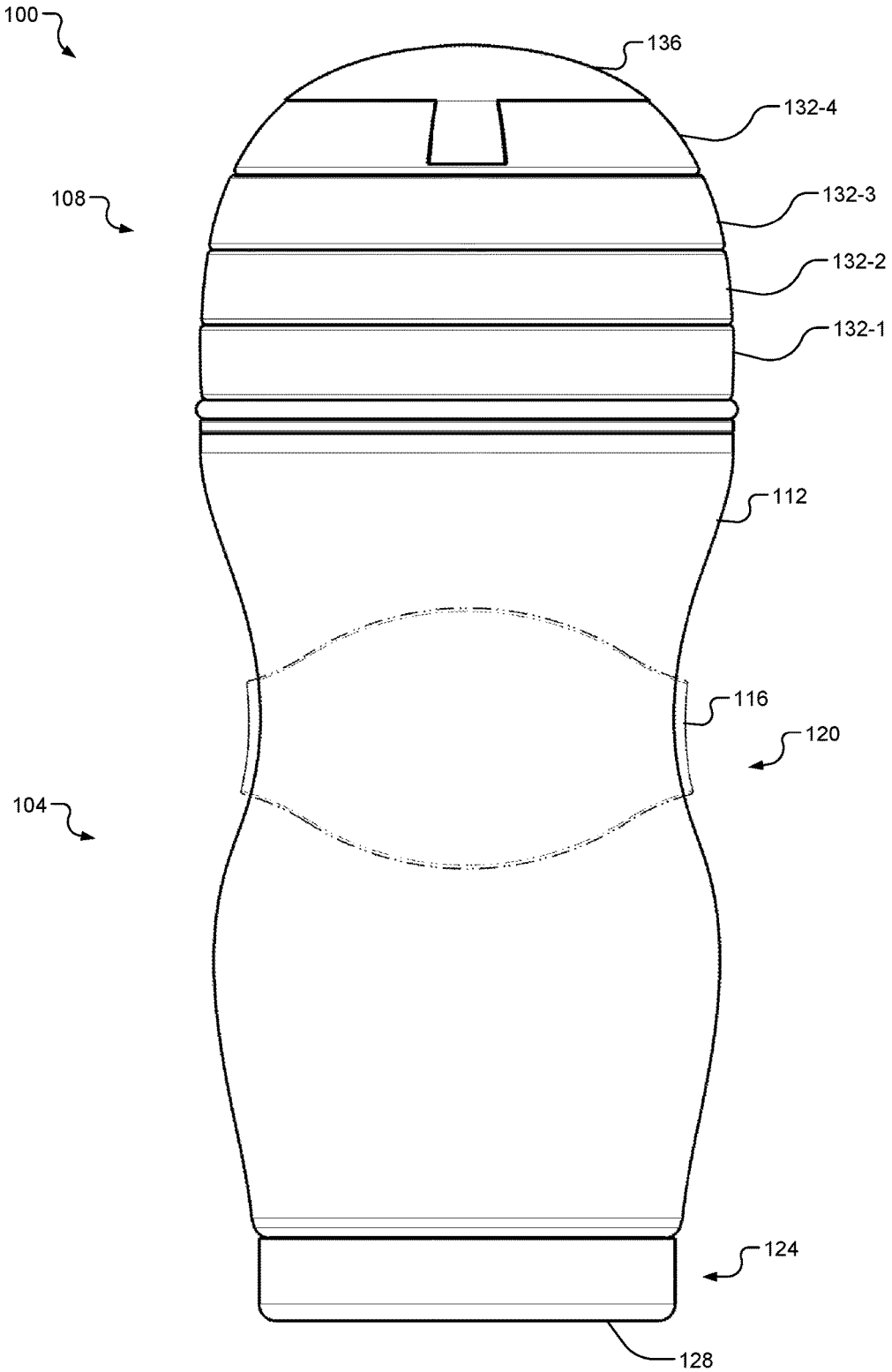
FIG. 1 illustrates a cosmetics container according to the principles of the present disclosure.

Referring now to FIG. 1, a cosmetics container 100 includes a main body 104 and an upper cap portion 108. The main body 104 includes an outer body 112 that encloses an inner storage compartment. For example only, the outer body 112 can be formed from stainless steel, plastic, or any other suitable material. A gripper 116 (comprised of, for example, neoprene or other rubber material, soft plastic, or any other suitable synthetic or non-synthetic material) encircles the outer body 112 at a middle narrow portion (i.e., a "waist") 120 of the main body 104. For example, the gripper 116 may be formed to resemble a waistband encircling the waist 120 of the main body 104. The cosmetics container 100 may have a size and shape resembling a cup or thermos and may be stored and/or transported in, for example only, a purse or handbag, backpack, suitcase, and/or briefcase.

A bottom cap portion 124 may be removable and include a hollow inner portion for additional storage. The bottom cap portion 124 may also provide a shock absorbing function during transportation or other use of the container 100. For example, the bottom cap portion 124 may absorb vibration caused by transportation of the container 100. For example only, the bottom cap portion 124 may include bottom pad 128. The bottom pad 128 may be formed from rubber, soft plastic, or any other suitable synthetic or non-synthetic material.

The upper cap portion 108 includes one or more rotatable storage shelves 132-1, 132-2, 132-3, and 132-4, referred to collectively as storage shelves 132, and a lid 136. Although the upper cap portion 108 is shown to include four shelves 132, any number of shelves 132 may be provided. The shelves 132 and the lid 136 are shown in a closed position. Any one of the shelves 132 can be rotated (e.g., to the left and/or right of the container 100) to an open position independently of remaining ones of the shelves 132 to expose contents of the one of the shelves 132. Or, each of the shelves 132 can all be rotated to different open positions around a common axis to expose the contents of all of the shelves 132. Conversely, the lid 136 may open via a hinge or other attachment mechanism. An inner surface of the lid 136 includes a mirror. When the lid 136 and one or more of the shelves 132 are in the open position, the mirror is viewable by a user while the contents of the open ones of the shelves 132 are available to the user for application.

When the storage shelves 132 are in the open position, an opening through the upper cap portion 108 into the inner storage compartment of the main body 104 is revealed. Accordingly, the opening provides access to cosmetics items stored in the inner storage compartment, even when the upper cap portion 108 is attached to the main body 104, through the bottom of the upper cap portion 108. Or, the upper cap portion 108 may be removed from the main body 104 to provide access to the inner storage compartment of the main body. For example, the upper cap portion 108 may be removed and placed on any surface for use, or may be stored and/or transported independently of the main body 104. For example only, a bottom edge or surface of the upper cap portion 108 may include one or more friction elements such as a notched surface, grip pads, or magnets to stabilize the upper cap portion 108 on a surface.

Figure 2:
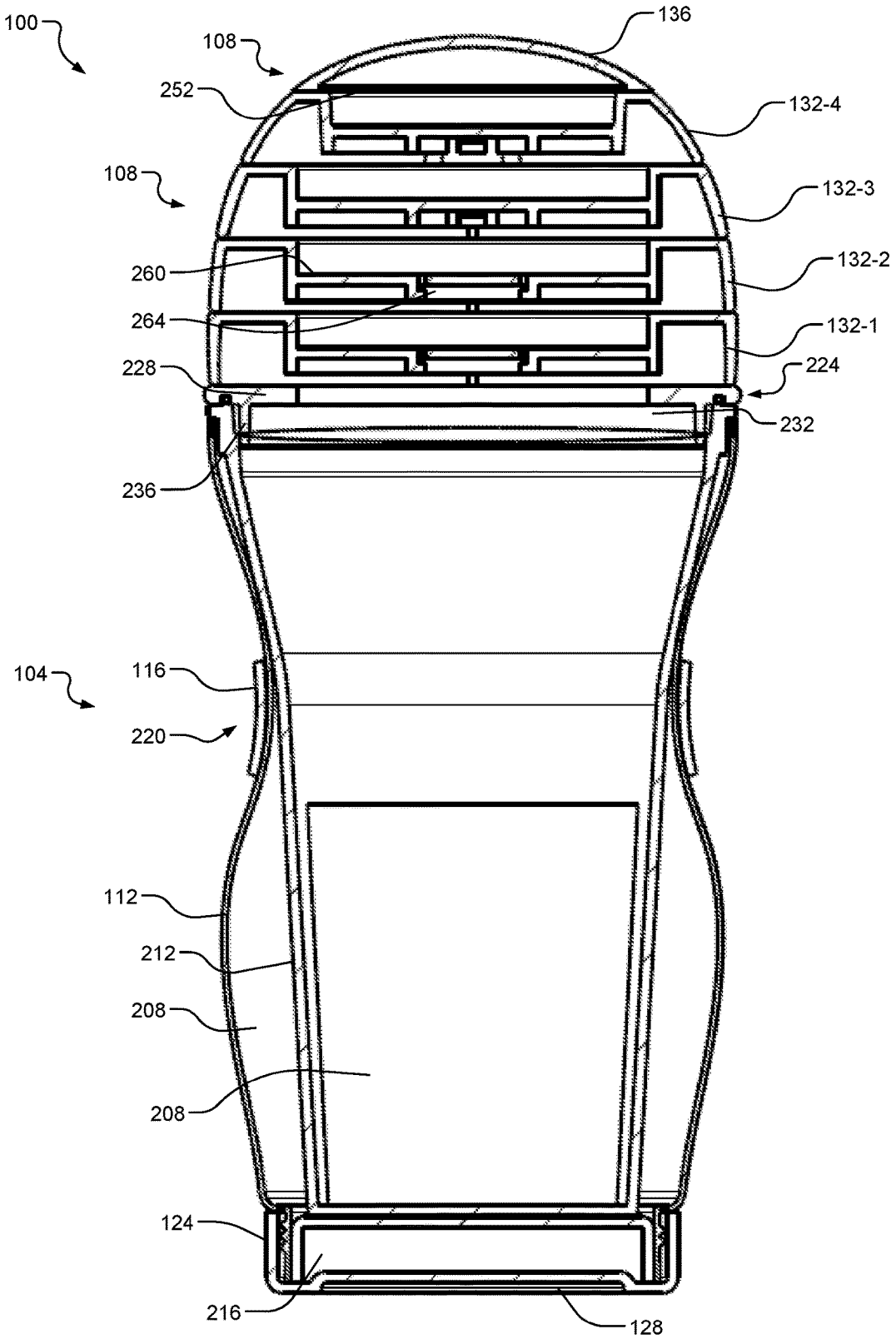
FIGS. 2, 3, and 4 illustrate various cross sectional views of the cosmetics container according to the principles of present disclosure.
Figure 3:
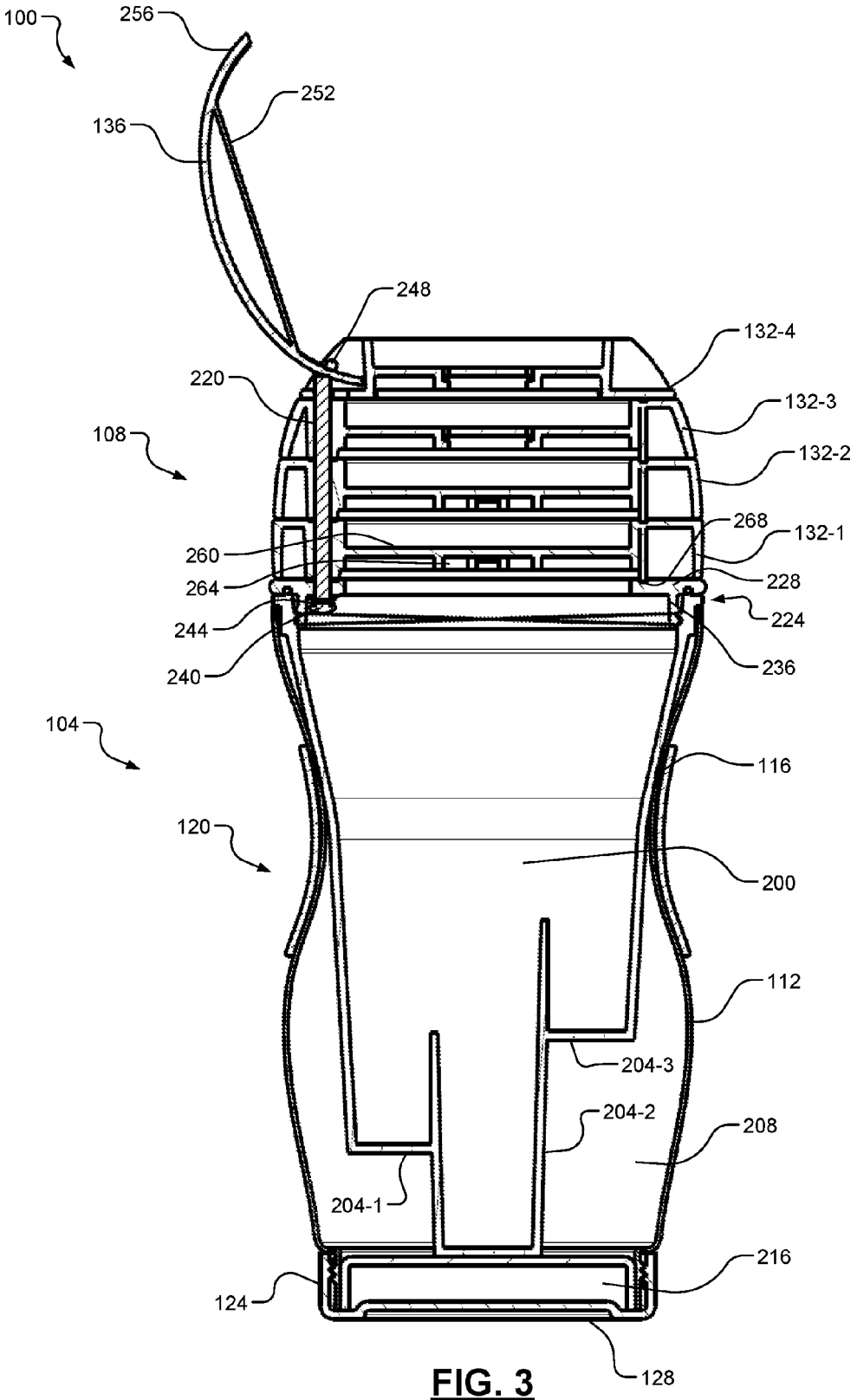
Figure 4:
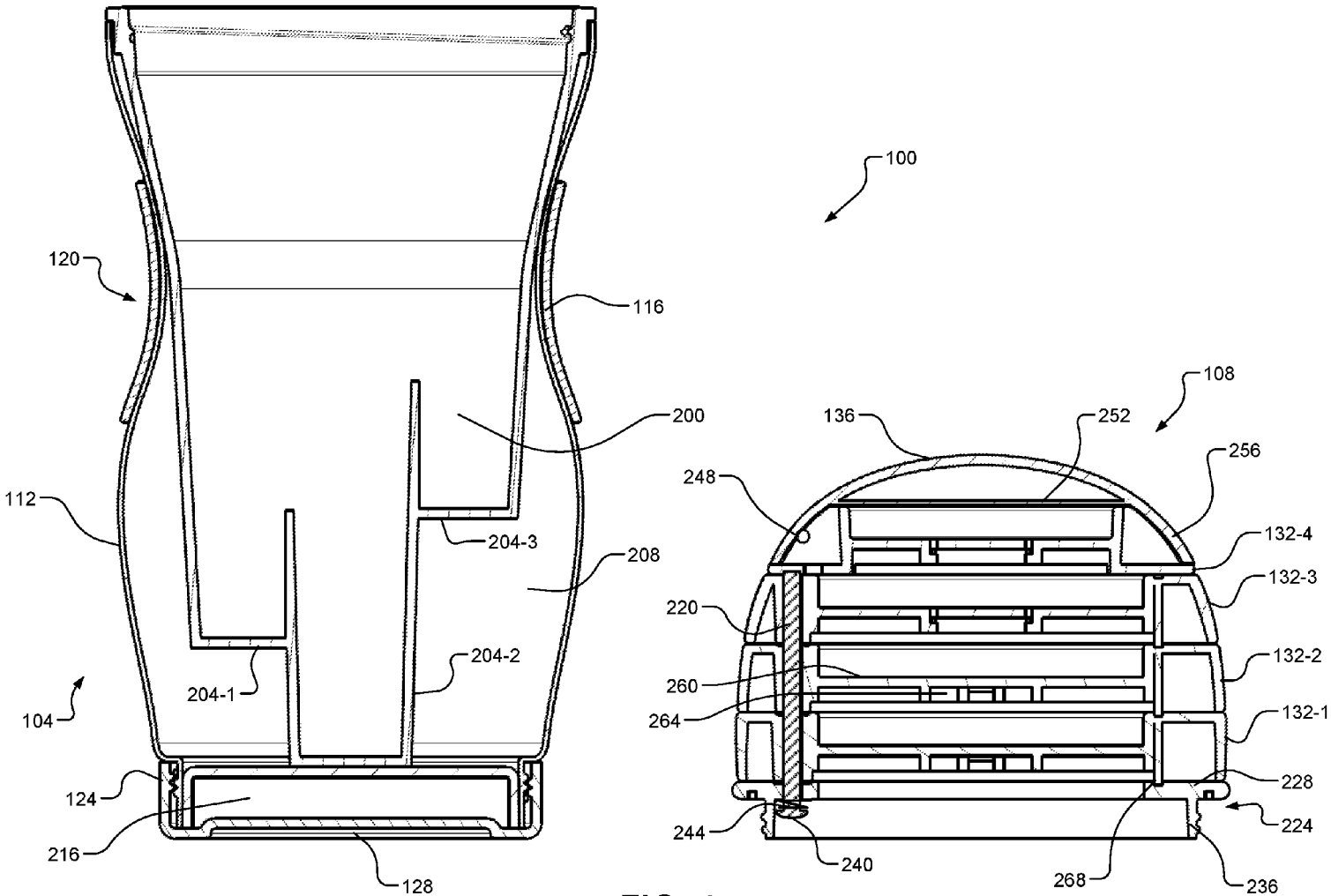

Referring now to FIGS. 2, 3, and 4, a front view cross section of the container 100, a side view cross section of the container 100 with the lid 136 open, and a side view cross section of the container 100 with the upper cap portion 108 removed, respectively, are shown. The outer body 112 encloses an inner storage compartment 200. The inner storage compartment 200 is formed of stainless steel, plastic, or any other suitable material and may be removably inserted within the main body 104 or fixedly attached within the main body 104. The inner storage compartment 200 includes multiple storage partitions 204-1, 204-2, and 204-3. Although the inner storage compartment 200 is shown to include three storage partitions 204, any number of partitions 204 may be included. Inner regions of the main body 104 that are not occupied by the inner storage compartment 200 may be filled with, for example only, insulative foam 208. Or, the inner regions of the main body 104 not occupied by the inner storage compartment 200 may be empty and accessible through openings in the bottom of the container 100 for additional storage when the bottom cap portion 124 is removed. The main body 104 may also include a rigid inner body portion 212.

Each of the storage partitions 204 may have a different depth, shape, and/or overall size to accommodate cosmetics items having different sizes, shapes, and lengths. For example, cosmetics items such as eyeliner, lip liner, lip gloss, lipstick, mascara, a brow pencil or powder, makeup brushes, tweezers, and/or toothpicks may have different sizes and shapes. A relatively smaller item may be difficult to access in, for example, the partition 204-2. Conversely, a relatively larger item may not fit into, for example, the partition 204-3. Accordingly, the partitions 204 allow items having different sizes and shapes to be stored in the inner storage compartment 200 while upper ends of the items are still reachable by a user at approximately the same height of the inner storage compartment 200.

The bottom cap portion 124 includes a hollow inner portion 216 to provide concealed storage. The bottom cap portion 124 is removable to provide access to the inner portion 216. For example, an outside surface of a bottom edge of the outer body 112 may be threaded. Conversely, an inside surface of the bottom cap portion 124 may be threaded to receive the threaded surface of the outer body 112.

The upper cap portion 108 includes a post 220 that secures the shelves 132 to a base 224 of the upper cap portion 108. For example, the post 220 extends from an upper one of the shelves 132-4, through an upper ledge 228, and into an open region 232 within a base ring 236 of the base 224. The base ring 236 provides an interface to removably attach the base 224 to the main body 104. For example, the base ring 236 and an inner surface of a rim of the main body 104 may each be threaded to provide threaded attachment between the upper cap portion 108 and the main body 104. Or, a bottom surface of the base ring 236 may be magnetic to provide magnetic attachment between the upper cap portion 108 and the main body 104.

A biasing member 244 such as a spring is positioned on the post 220 between the ledge 228 and a flanged end 240 of the post 220. The biasing member 244 biases the post 220 in a downward direction (i.e., in a direction of the flanged end). Conversely, a top end of the post 220 may be fixedly attached to the upper shelf 132-4. Accordingly, the biasing of the post 220 in the downward direction creates vertical tension between the shelves 132 (e.g., compresses the shelves 132 in the downward direction).

The shelves 132 are configured to rotate from the closed position to the open position about a common axis defined by the post 220. For example, the post 220 is inserted though respective openings in each of the shelves 132 to provide a common attachment point for the shelves 132, and each of the shelves 132 is independently rotatable around the axis defined by the post 220. The tension created by the biasing member 244 maintains the shelves 132 in their respective positions, whether closed or in any open position.

A hinge member 248 such as a pin attaches the lid 136 to the upper cap portion 108. The lid 136 opens and closes on an axis defined by the hinge member 248. The hinge member 248 may include a biasing or frictional elements to maintain the lid 136 in the open position during use. A mirror 252 is attached to and faces outward from an inner surface of the lid 136. Accordingly, when the lid 136 is open, the mirror 252 is visible to a user. The lid 136 includes a latch 256 that secures the lid 136 in the closed position. For example, the latch 256 may secure the lid 136 via a magnetic or any other suitable fastening or tensioning mechanism.

Each of the shelves 132 includes a respective interface 260 for receiving and storing specific types of cosmetics items such as eye shadow, blush, bronzer, foundation, and concealer. For example, these types of cosmetics items are typically provided in pans. Each pan may include one type or color of a particular cosmetic. Accordingly, each of the shelves 132 may store one or more pans of any type of cosmetics item. For example, the shelf 132-4 may include one or more foundation pans, while the shelf 132-3 includes one or more blush pans, and the shelf 132-2 includes one or more eye shadow pans. Or, each of the shelves 132 may include pans of different colors of the same cosmetic type. In either configuration, the cosmetics items of all of the shelves 132 are available to the user when the shelves 132 and the lid 136 are in respective open positions. Further, the opening in the bottom of the upper cap portion 108 allows access to any cosmetics items storing in the main body 104.

The pans stored in the shelves 132 may be metallic. Accordingly, the bottoms of the pans provide a magnetic surface. Recessed openings 264 below the interfaces 260 may include one or more magnets to secure the pans within the shelves 132. Accordingly, when the shelves 132 are in the open positions, the magnets prevent the pans from falling out of the shelves 132. The interfaces 260 may be configured to accommodate pans of any size or shape.

In some implementations, the portions of the main body 104 may be formed from transparent plastic or other material. For example, the outer body 112, inner body 212, and storage partitions 204 may all be transparent. Accordingly, contents of the main body 104 may be easily viewable from outside of the container 100. In this manner, approximate volumes of any liquids or other items stored in the container 100 may be readily discernible by, for example only, airport or other security screeners.

Further, volumes of each of the individual storage partitions 204 may be based on maximum allowable volumes for carry on air travel. For example only, the volumes of selected ones (or, all) of the storage partitions 204 may each be approximately 3.4 ounces for items reaching from the bottom of the partition to the top of the main body 104. Or, each of the storage partitions 204 may include an indicator (such as a line) that indicates an approximate maximum size of an item that is still within the maximum allowable volume.

Figure 5:
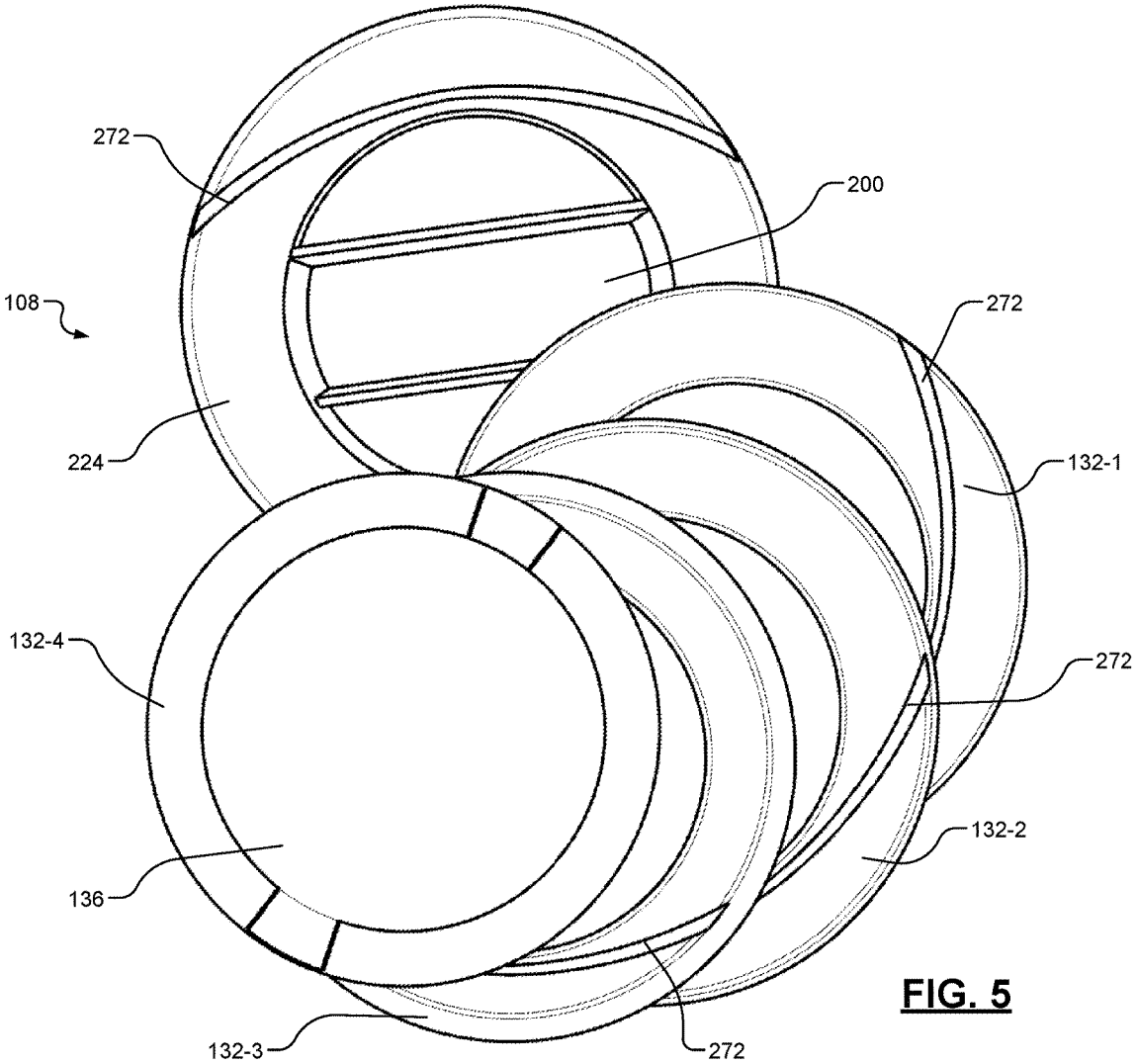
FIGS. 5 and 6 illustrate a top down view of the cosmetics container according to the principles of present disclosure.
Figure 6:
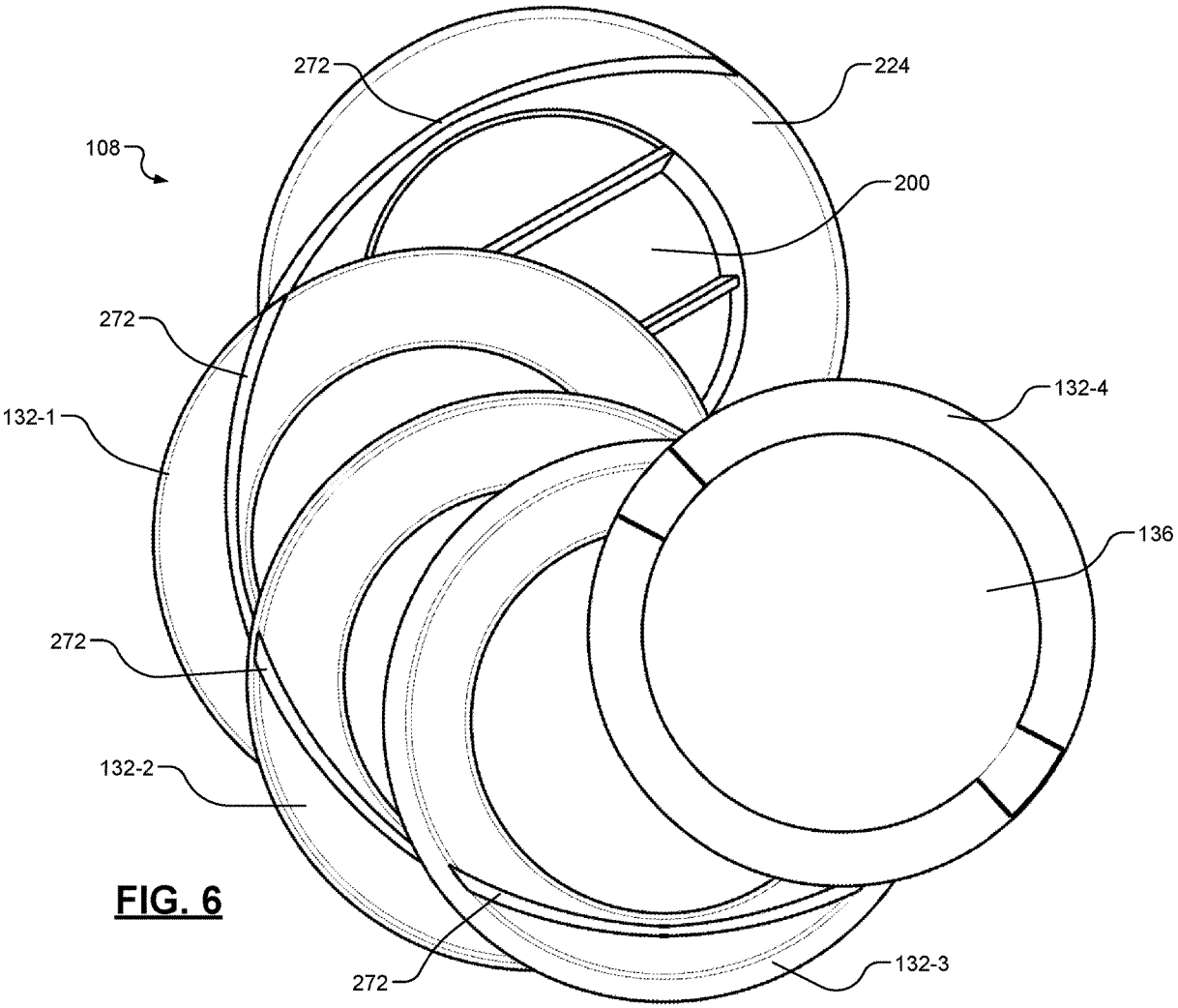

Referring now to FIGS. 5 and 6 in addition to FIGS. 2, 3, and 4, two top down views of the upper cap portion 108 with the shelves 132 in respective open positions are shown. Each of the shelves 132 may include a respective tab 268 or other protrusion on respective lower surfaces of the shelves 132. The tab 268 is received within a corresponding groove 272 in an upper surface of a next lower one of the shelves 132. The grooves 272 may have varied depths along the lengths of the grooves 272 to capture the tabs 268 in various positions. In other words, as one of the shelves 132 rotates with respect to a corresponding lower shelf 132, the corresponding groove 272 of the lower shelf 132 may capture the tab 268 in a particular position, thereby securing the rotated shelf in a particular open position. Or, as the shelf 132 rotates and its respective tab is captured at a point along the corresponding groove 272, continued rotation of the shelf 132 by the user will cause the lower shelf 132 to begin to rotate as well. Accordingly, the user may open multiple ones of the shelves 132 simply by rotating one of the shelves 132.

For example, if the user begins to rotate the shelf 132-4, the tab 268 of the shelf 132-4 may be captured by the groove 272 of the shelf 132-3. The user may leave the shelf 132-4 partially rotated to provide some access to the cosmetics item in the shelf 132-3. Or, the user may continue to rotate the shelf 132-4 while securing the remaining shelves 132 in the closed position. Or, the user may continue to rotate the shelf 132-4, allowing the captured tab 268 to also rotate the shelf 132-3. The tab 268 of the shelf 132-3 will similarly rotate the shelf 132-2, and the tab 268 of the shelf 132-2 will rotate the shelf 132-1 until all of the shelves 132 are open as shown in FIGS. 6 and 7. As further shown in FIGS. 6 and 7, access to the inner storage compartment 200 is also provided when all of the shelves 132 are open.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

What is claimed is:

1. A cosmetics container, comprising:

a main body having an inner storage compartment accessible via a first opening in the main body; and an upper cap portion configured to be removably attached to the main body, the upper cap portion including at least one shelf rotatable to the left or right of the first opening in the main body between a closed position and an open position, wherein the upper cap portion includes a base, the base including a base ring configured to provide an interface for attaching the upper cap portion to the main body and completely detaching the upper cap portion, including the base and base ring, from the main body, and the at least one shelf is directly adjacent to the base and is rotatable relative to the base of the upper cap portion when the upper cap portion is attached to the main body.

2. The cosmetics container of claim 1, wherein the at least one shelf includes an interface for storing a cosmetics item.

3. The cosmetics container of claim 2, wherein the at least one shelf includes at least one pan for storing the cosmetics item.

4. The cosmetics container of claim 3, wherein the at least one pan is removable from the at least one shelf.

5. The cosmetics container of claim 4, wherein a lower surface of the interface of the at least one shelf includes a magnet, and wherein the magnet retains the at least one pan on the interface via magnetic contact between the magnet and the at least one pan.

6. The cosmetics container of claim 1, further comprising a bottom cap portion removably attached to a lower end of the main body.

7. The cosmetics container of claim 6, wherein the bottom cap portion includes a hollow inner portion that is accessible when the bottom cap portion is removed from the lower end of the main body.

8. The cosmetics container of claim 6, wherein a bottom surface of the bottom cap portion includes a bottom pad.

9. The cosmetics container of claim 1, wherein the upper cap portion includes a lid arranged above the at least one shelf, and wherein an inner surface of the lid includes a mirror.

10. The cosmetics container of claim 1, wherein the at least one shelf includes a plurality of shelves, each of the plurality of shelves being rotatable to the left or right of the first opening in the main body, independently of remaining ones of the plurality of shelves, between the closed position and a respective open position.

11. The cosmetics container of claim 10, wherein a lower surface of each of the plurality of shelves includes a tab that protrudes downward from the lower surface and is received in a groove in an upper surface of a next lower one of the plurality of shelves.

12. The cosmetics container of claim 11, wherein rotating one of the plurality of shelves beyond the respective open position causes the next lower one of the plurality of shelves to rotate.

13. The cosmetics container of claim 11, wherein a depth of the groove is varied along a length of the groove.

14. The cosmetics container of claim 13, wherein the depth of the groove is varied to capture the tab and retain a next upper one of the plurality of shelves in a desired position.

15. The cosmetics container of claim 14, wherein the depth of the groove is varied to retain the next upper one of the plurality of shelves at the closed position and the respective open position.

16. The cosmetics container of claim 10, wherein, when each of the plurality of shelves are in the respective open positions, the first opening of the main body is revealed to provide access to the inner storage compartment through an open region within the base ring of the base.

17. The cosmetics container of claim 16, wherein each of the plurality of shelves is rotatable about a common axis.

18. The cosmetics container of claim 17, further comprising a post that defines the common axis, wherein the post extends through a ledge of the base into the open region within the base ring.

19. The cosmetics container of claim 18, wherein the post extends from an uppermost one of the plurality of shelves through respective openings in each of the plurality of shelves.

20. The cosmetics container of claim 19, further comprising a biasing member disposed on the post between a lower end of the post and a lower surface of the ledge of the base, wherein the biasing member biases the post downward to compress each of the plurality of shelves in a downward direction to maintain the plurality of shelves in respective desired positions.

* * * * *